US011207721B2

(12) United States Patent
Kang et al.

(10) Patent No.: US 11,207,721 B2
(45) Date of Patent: Dec. 28, 2021

(54) ROLL FOR HOT ROLLING PROCESS AND METHOD FOR MANUFACTURING SAME

(71) Applicant: FUJICO CO., LTD., Fukuoka (JP)

(72) Inventors: Hyo-Gyoung Kang, Fukuoka (JP); Akio Sonoda, Fukuoka (JP); Hideaki Nagayoshi, Fukuoka (JP); Hiroaki Furuta, Okayama (JP); Hiroyuki Miyazaki, Fukuoka (JP)

(73) Assignee: FUJICO CO., LTD., Fukuoka (JP)

( * ) Notice: Subject to any disclaimer, the term of this patent is extended or adjusted under 35 U.S.C. 154(b) by 489 days.

(21) Appl. No.: 15/776,892

(22) PCT Filed: Nov. 15, 2016

(86) PCT No.: PCT/JP2016/083743
§ 371 (c)(1),
(2) Date: May 17, 2018

(87) PCT Pub. No.: WO2017/086281
PCT Pub. Date: May 26, 2017

(65) Prior Publication Data

US 2018/0361445 A1 Dec. 20, 2018

(30) Foreign Application Priority Data

Nov. 17, 2015 (JP) ..... JP2015-225132

(51) Int. Cl.
*B21B 27/03* (2006.01)
*C21D 9/38* (2006.01)
(Continued)

(52) U.S. Cl.
CPC ..... *B21B 27/03* (2013.01); *B21B 39/00* (2013.01); *B22D 11/00* (2013.01); *B22D 11/002* (2013.01);
(Continued)

(58) Field of Classification Search
CPC ..... B21B 27/00; B21B 27/021; B21B 27/03; B21B 27/032; B21B 27/02; C22C 38/00;
(Continued)

(56) References Cited

U.S. PATENT DOCUMENTS 6,406,566 B1 * 6/2002 Ishida ..... C22C 9/01 148/402
7,513,960 B2 * 4/2009 Inoue ..... C22C 38/34 148/326
(Continued)

FOREIGN PATENT DOCUMENTS

CN 101773935 A 7/2010
CN 103624084 A 3/2014
(Continued)

OTHER PUBLICATIONS

JP 03138010 A MT (Year: 1991).*
(Continued)

*Primary Examiner* — Adam J Eiseman
*Assistant Examiner* — Fred C Hammers
(74) *Attorney, Agent, or Firm* — Bacon & Thomas, PLLC

(57) ABSTRACT

[PROBLEM] The invention provides a roll for hot rolling process having various types of more excellent durability performances than conventional rolls, and provides also a method for manufacturing the same.
[SOLUTION] A cladding layer 4 is formed on an outer circumference portion of a roll for hot rolling process 1, where the cladding layer 4 comprises: 0.5 to 0.7% by mass of C, 2.8 to 4.0% by mass of Si, 0.9 to 1.1% by mass of Cu, 1.4 to 1.6% by mass of Mn, 2.7 to 3.3% by mass of Ni, 13.5 to 14.5% by mass of Cr, 0.8 to 1.1% by mass of Mo, 0.9 to 1.1% by mass of Co, and 0.2 to 0.4% by mass of Nb, with a balance being Fe and inevitable impurities, and has a thickness of 5 mm or more.

7 Claims, 3 Drawing Sheets

(51) Int. Cl.

| | |
|---|---|
| ***C22C 38/58*** | (2006.01) |
| ***B22D 19/16*** | (2006.01) |
| ***B22D 11/00*** | (2006.01) |
| ***B21B 39/00*** | (2006.01) |
| ***C22C 1/02*** | (2006.01) |
| ***C21D 6/00*** | (2006.01) |
| ***C22C 38/34*** | (2006.01) |
| ***C22C 38/42*** | (2006.01) |
| ***C22C 38/44*** | (2006.01) |
| ***C22C 38/48*** | (2006.01) |
| ***C22C 38/52*** | (2006.01) |

(52) U.S. Cl.
CPC ..... *B22D 11/008* (2013.01); *B22D 19/16* (2013.01); *C21D 6/004* (2013.01); *C21D 6/005* (2013.01); *C21D 6/007* (2013.01); *C21D 6/008* (2013.01); *C21D 9/38* (2013.01); *C22C 1/02* (2013.01); *C22C 38/34* (2013.01); *C22C 38/42* (2013.01); *C22C 38/44* (2013.01); *C22C 38/48* (2013.01); *C22C 38/52* (2013.01); *C22C 38/58* (2013.01)

(58) Field of Classification Search
CPC ..... C22C 38/04; C22C 38/08; C22C 38/60; C21D 9/0012; C21D 9/0025; B22D 11/00; B22D 11/002; B22D 11/007; B22D 11/008; B22D 19/16
USPC ..... 148/522, 529, 622; 72/252.5, 252, 500; 164/98, 442, 448, 461; 29/235, 255, 280
See application file for complete search history.

(56) References Cited

U.S. PATENT DOCUMENTS

| | | | | |
|---|---|---|---|---|
| 2003/0192626 | A1* | 10/2003 | Takiguchi | C22C 38/50 148/405 |
| 2009/0092852 | A1* | 4/2009 | Furushima | C22C 38/24 428/656 |
| 2011/0200479 | A1* | 8/2011 | Mihara | C22C 9/06 420/470 |
| 2011/0265916 | A1* | 11/2011 | Oishi | C22C 9/06 148/501 |
| 2012/0199253 | A1* | 8/2012 | Ishida | C22C 30/02 148/563 |
| 2014/0345353 | A1* | 11/2014 | Oda | C21D 9/0068 72/252.5 |
| 2015/0376748 | A1* | 12/2015 | Ichino | B21B 27/00 492/3 |

FOREIGN PATENT DOCUMENTS

| | | | | | |
|---|---|---|---|---|---|
| CN | 104001905 | A | | 8/2014 | |
| JP | H0 9070655 | A | * | 3/1977 | B22D 19/16 |
| JP | 59232657 | A | * | 12/1984 | B22D 11/1287 |
| JP | S59 232657 | A | * | 12/1984 | B22D 11/128 |
| JP | S59232657 | | * | 12/1984 | B22D 11/128 |
| JP | S60 121013 | | * | 6/1985 | B21B 27/02 |
| JP | S60 121013 | A | * | 6/1985 | |
| JP | S60121013 | | * | 6/1985 | B21B 27/02 |
| JP | H0 170920 | | * | 12/1988 | C21D 9/38 |
| JP | 03138010 | A | * | 10/1989 | B21B 27/03 |
| JP | H03138010 | A | | 6/1991 | |
| JP | H05 306427 | A | * | 4/1992 | C22C 37/00 |
| JP | H04 141553 | A | * | 5/1992 | C22C 38/00 |
| JP | H05 311335 | A | * | 5/1992 | B21B 27/00 |
| JP | H05 3113315 | A | * | 5/1992 | |
| JP | 050306427 | A | * | 11/1993 | C22C 37/00 |
| JP | 08 92698 | A | * | 9/1994 | C22C 38/00 |
| JP | 08-92698 | | * | 4/1996 | |
| JP | 08092698 | A | * | 4/1996 | C22C 38/00 |
| JP | H08109441 | A | | 4/1996 | |
| JP | H09 070655 | A | * | 3/1997 | |
| JP | H0970655 | A | | 3/1997 | |
| JP | H09070655 | A | * | 3/1997 | B22D 19/16 |
| JP | H10212552 | A | | 8/1998 | |
| JP | H02170920 | | * | 12/1998 | C21D 9/38 |
| JP | 2001_105176 | A | | 4/2001 | |
| JP | 2002_361482 | A | | 12/2002 | |
| JP | 2007 146276 | A | * | 4/2006 | C22C 37/00 |
| JP | 2006 152381 | | * | 6/2006 | C22C 38/00 |
| JP | 2006152381 | A | | 6/2006 | |
| JP | 2007 146276 | A | * | 6/2007 | |
| KR | 100724046 | B1 | * | 6/2007 | B23B 37/00 |
| WO | WO2004072308 | A2 | | 8/2004 | |

OTHER PUBLICATIONS

KR 100724046 B1 A MT (Year: 2007).*
JPH05 306427 A MT (Year: 1992).*
JPH05 3113315 A MT (Year: 1992).*
JPH04 141553 A MT (Year: 1992).*
JP08-92698 MT (Year: 1994).*
JP 2007 146276 A MT (Year: 2006).*
JPS60 121013 A MT (Year: 1985).*
JP H0 9070655 A MT (Year: 1997).*
JP050306427A MT (Year: 1993).*
JP08092698A MT (Year: 1996).*
JPS60121013 MT (Year: 1985).*
JPH02170920 MT (Year: 1998).*
JPS59 232657 MT (Year: 1984).*
Translated Internatonal Search Report—dated Dec. 13, 2016.
Extended European Search Report cited in European Appln. No. 19212037.6 dated Jan. 23, 2020.

* cited by examiner

ROLL FOR HOT ROLLING PROCESS AND METHOD FOR MANUFACTURING SAME

TECHNICAL FIELD

The present invention relates to a roll for heat rolling (hot rolling) process such as a wrapper roll, a pinch roll, a looper roll, and a conveyance table roll used in rolling equipment of a hot-rolled steel sheet, and relates also to a method for manufacturing the same.

BACKGROUND ART

A roll for hot rolling process used in rolling equipment for a hot-rolled steel sheet is often used in a high-temperature corrosive environment under a high mechanical load. This is because the roll for hot rolling process contacts cooling water and water vapor while coming in contact and colliding with a high-temperature steel sheet. Thus, various types of durability performances such as a corrosion resistance, a seizing resistance, a wear resistance, a thermal shock resistance, and a bruise resistance are required.

From such a viewpoint, conventionally, a roll having stainless steel containing about a few % to 10% of Cr at least on an outer circumference (surface layer portion) of a body is used as the roll for hot rolling process such as a wrapper roll. A steel material containing a large amount of Cr excels at corrosion resistance and oxidation resistance while having a high degree of hardness.

In the examples of Patent Literatures 1 and 2 described below, a roll in which the outer circumference of the body has a cladding layer (outer layer material) made of such material is also used. It is noted that in the following examples of Patent Literatures 1 and 2, the cladding layer is formed by a continuous pouring process for cladding (CPC process). As illustrated in FIG. 3, the continuous pouring process for cladding is a method of concentric-vertically inserting a solid or a hollow core material 23 made of steel into an inner portion of a hollow combined mold 21, pouring a molten metal 22 in an annular gap portion of the outside of the core material 23 and continuously lowering the core material 23 to deposit and solidify the above-described molten metal onto the outer circumference of the core material 23 to form a cladding layer 24. Unlike a case of forming the cladding layer by a welded hard-facing method or a spraying method, this method provides a benefit such that it is possible to efficiently form the cladding layer having a uniform component and structure by a one-time casting.

CITATION LIST

Patent Literature

[PTL 1] Japanese Unexamined Patent Application No. 9-70655

[PTL 2] Japanese Unexamined Patent Application No, 10-7212552 [sic, correctly 10-212552]

SUMMARY OF INVENTION

Technical Problem

In recent ironworks, while an operating condition of a roll for hot rolling process is becoming severe because of diversification of the hot-rolled material and an increased speed of the hot-rolling, it is strongly demanded to reduce the manufacturing cost by decreasing the frequency of the roll replacement and the like. In addition, there is a strong demand for surface quality of the rolled product, and thus, it is also necessary to improve a maintaining characteristic of the surface property of the roll. From such a situation, the roll for hot rolling process is demanded to have a durability performance better than before.

The present invention provides, based on the above-described demands in the recent ironworks, a roll for hot rolling process having more excellent durability performance than the conventional roll, and provides also a method for manufacturing the same.

Solution to Problem

A first roll for hot rolling process according to the invention has a cladding layer on an outer circumference portion, wherein the cladding layer includes: 0.5 to 0.7% by mass of C, 2.8 to 4.0% by mass of Si, 0.9 to 1.1% by mass of Cu, 0.5 to 2.0% by mass of Mn, 2.7 to 3.3% by mass of Ni, 13.5 to 14.5% by mass of Cr, 0.8 to 1.1% by mass of Mo, 0.9 to 1.1% by mass of Co, and 0.2 to 0.4% by mass of Nb, with the balance being Fe and inevitable impurities, and has a thickness of 5 mm or more.

In such a roll, the cladding layer on the outer circumference portion has a significant mechanical strength such as tensile strength, durability, elasticity, drawing, and hardness (in particular, hardness at high temperature), and excels at wear resistance, seizing resistance, thermal shock resistance, high-temperature oxidation resistance property, and the like. Thus, the roll is suitable for the roll for hot rolling process used in rolling equipment of a hot-rolled steel sheet, such as a wrapper roll, a pinch roll, a looper roll, and a conveyance table roll, and exhibits a high durability performance.

In addition, the cladding layer is thick, that is, has a thickness of 5 mm or more. Therefore, when a wear progresses and a surface scratch, or the like occurs during use, it is possible to reuse the roll by re-grinding the outer circumference surface, and thus, the roll can be used over a significantly long period of time. Further, if the cladding layer has a thickness of 5 mm or more, a separation or crack is less likely to occur even when the roll is affected by a high thermal shock or a physical load.

Further, a second roll for hot rolling process according to the invention has a cladding layer on an outer circumference portion, wherein the cladding layer includes: 0.7 to 0.9% by mass of C, 3.0 to 4.2% by mass of Si, 0.9 to 1.1% by mass of Cu, 1.4 to 1.6% by mass of Mn, 2.7 to 3.3% by mass of Ni, 13.5 to 14.5% by mass of Cr, 1.8 to 4% by mass of Mo, 0.9 to 1.1% by mass of Co, and 0.9 to 1.1% by mass of Nb, with the balance being Fe and inevitable impurities, and has a thickness of 5 mm or more.

Compared to the conventional cladding layer, the present invention is characterized by newly adding approximately 1% of Cu and Co while the Cr is increased to 13.5 to 14.5%. This point is common with the aforementioned roll (first roll for hot rolling process).

Similarly to the afbrementioned roll, in such a roll, the cladding layer on the outer circumference portion has a significant mechanical strength such as tensile strength, durability, elasticity, drawing, and hardness (in particular, hardness at high temperature), and excels at wear resistance, seizing resistance, thermal shock resistance, high-temperature oxidation resistance property, and the like. Therefore, such a roll exhibits a high durability performance when being used as a roll for hot rolling process in the rolling equipment of the hot-rolled steel sheet such as a wrapper roll, a pinch roll, a looper roll, and a conveyance table roll. Compared to the aforementioned roll, the roll contains slightly more C and Si and the content of Mo and Nb is large. Therefore, the high-temperature property is further enhanced (less likely to soften at high temperature), and thus, the roll of the present invention is particularly suitable to be used as a pinch roll and the like in which the collision of the steel sheet easily occurs to generate bruises.

In this roll also, the cladding layer on the outer circumference portion is thick, that is, has a thickness of 5 mm or more, and thus, there is a benefit in that the roll can be used over a significant long period of time because the outer circumference surface can be repeatedly reworked.

It is particularly preferable that in the above-described cladding layer, a high temperature hardness of the surface at 500° C. is HS 50 or more.

In general, the harder the surface of the cladding layer on the outer circumference portion in the roll for hot rolling process, the more advantageous it is in terms of durability. The surface becomes approximately 500° C. after coming in contact with the hot-rolled steel sheet, and thus, it is particularly preferable that the surface has a high surface hardness at such a high temperature.

If the surface hardness at 500° C. is set to HS 50 or more in a roll having the aforementioned chemical component, the wear resistance and the seizing resistance at such temperature is particularly enhanced to exhibit an excellent durability performance as a roll for hot rolling process.

It is further preferable, in terms of the durability performance of the roll for hot rolling process, when the above-described cladding layer has the seizing resistance (critical ratio to slip initiation, seizing width of 0.5 mm or more) at the time of SUS (stainless steel) rolling of 60% or more and the corrosion resistance (corrosion mass loss) in a 48-hour corrosion resistance test (JIS Z2371) of 0.0065 mg/mm2 or less.

It is preferable that the above-described roll for hot rolling process has a configuration in which a sleeve made of carbon steel has the above-described cladding layer on the outer circumference portion, and the sleeve is fitted onto the outside of a roll shaft to form the body. FIG. 1 illustrates an example of such a roll. Reference numeral 3 in the figure is the sleeve having a cladding layer 4 on the outer circumference portion. The sleeve 3 is fitted onto a roll shaft 2, forming a body 5 coming in contact with the hot-rolled steel sheet.

As the roll for hot rolling process of the invention, it is also possible to adopt a configuration in which the roll shaft itself is integrated as one with the body and the cladding layer is provided on the outer circumference portion thereof. But, if the sleeve is fitted onto the roll shaft to form a body and the cladding layer is formed on the outer circumference portion of the sleeve as described above, the same roll shaft can be used over a significant long period of time by replacing the sleeve. For example, in a case where the cladding layer becomes thinner as a result of a repeated cutting work in accordance with the wearing of the cladding layer or a case where it is attempted to modify a material of the surface of the roll (body) in accordance with the material or the like of the hot-rolled steel sheet, the roll can be used simply by replacing the sleeve attached with the cladding layer without modifying the roll shaft.

If the sleeve (portion other than the cladding layer) is made of carbon steel (low carbon steel, that is, soft steel), the sleeve combines both the shock resistance and the hardness on a whole sleeve. As a result, the cladding layer is less likely to crack or separate, and thus, and it is particularly advantageous in terms of the durability performance.

It is noted that the sleeve, before being fitted onto the roll shaft, is small in size relative to the whole roll including the roll shaft, and thus, it is light weight and easy to be handled. Therefore, if the cladding layer is formed on the sleeve before being fitted onto the roll shaft, which is treated with heat, for example, the work can be simplified and made efficient in many steps, and it is possible to reduce the cost of the roll for hot rolling process and to shorten the manufacturing duration.

It is further preferable if the above-described cladding layer on the outer circumference portion is formed by a continuous pouring process for cladding (CPS process) where the solid shaft or the sleeve forming the body is used as the core material. The continuous pouring process for cladding is the aforementioned method of pouring and solidifying molten metal into a surrounding of the core material in a manner illustrated in FIG. 3 to continuously form the cladding layer.

As described above, according to the continuous pouring process for cladding, unlike a case of forming the cladding layer by the welded hard-facing method and the spraying method, there is a benefit of efficiently forming, by a one-time casting, the cladding layer having a uniform component and structure with a sufficient thickness. Further, it is possible to form a strong metal bonding in which a boundary portion between the core material and the cladding layer cannot be separated. Further, unlike a case in which any layer is formed by a centrifugal casting and a general static casting, a cooling speed at a time of casting can be increased and a segregation and an abnormal carbide are not easily generated, and thus, a large amount of Cr, V, Mo, and the like can be added. As a result, it is not difficult to enhance the mechanical strength, the corrosion resistance, and the like of the layer to be casted. Therefore, the above-described roll in which the above-described cladding layer is formed by the continuous pouring process for cladding has various extremely preferable properties for the durability performance.

The method for manufacturing the roll for hot rolling process according to the invention is characterized in that a solid shaft or a sleeve forming the body is used as a core material, and the above-described cladding layer is formed on the outer circumference portion thereof by the continuous pouring process for cladding.

When the cladding layer on the outer circumference portion is formed by the continuous pouring process for cladding, the following benefits are obtained: a) a cladding layer having a uniform component and structure and a sufficient thickness mm or more) can be efficiently formed by a one-time casting; b) a strong metal bonding that does not separate between the core material and the cladding layer can be formed; and c) a large amount of Cr, V, Mo and the like can be added, and thus, it is possible to enhance the mechanical strength, the corrosion resistance and the like of the cladding layer, as described above. Therefore, according to the manufacturing method described above, it is possible to efficiently manufacture a roll for hot rolling processing having an excellent durability performance.

It is particularly preferable that the solid shaft or the sleeve on which the cladding layer is formed by the above-described method is quenched by a forced air cooling after performing a solution treatment at 1000° C. for seven hours, and is further subject to aging treatment at 400° C. to 600° C. for seven hours, while annealing is not performed after a continuous pouring process for cladding.

If the solution treatment is performed, and then the rapid cooling and the age hardening treatment are performed in this manner, an alloy element is uniformly dissolved into the steel by the solution treatment, and in addition, a homogenous and fine precipitant compound can be formed by the age hardening treatment. Therefore, the cladding layer containing the above-described chemical component improves the mechanical strength, the heat resistance, and the corrosion resistance to provide an exceptional durability performance.

The annealing after the continuous pouring process for cladding is usually performed to prevent straining during cooling and to soften the material to improve workability. However, in a case of the material according to the present invention, the product after casting has an approximately 50% level austenite structure, and thus, a product having softness and little strain can be manufactured. If annealing is performed after casting, even although a secondary dendrite and a crystal grain structure are refined by rapid cooling (quenching), the annealing at a high temperature for a long period of time results in a coarse crystal grain. In addition, a secondary precipitant carbide of M23C6 consisting mainly of Cr is precipitated in the vicinity of the grain boundary. Consequently, a segregation of Cr concentration is formed near a crystal grain boundary, resulting in a loss of corrosion resistance. Further, if the annealing is performed after the continuous pouring process for cladding, a higher temperature and a longer period of time for maintenance are necessary for the solution treatment performed to dissolve much Cr carbides of M7C3 and M23C6 onto a base structure. Therefore, it is desirable to further improve the corrosion resistance provided in the material component of the present invention by attempting homogenization by the solution treatment at a low temperature for a short period of time by omitting the annealing after the continuous pouring process for cladding.

It is noted that a finishing machine work on the cladding layer surface is performed after the above-described heat treatment.

It is preferable that the sleeve on which the cladding layer is formed is fitted onto the outside of the roll shaft to form the body after performing the solution treatment, the quenching, and the aging treatment described above. That is, the body of the roll is configured by a sleeve, and the sleeve is fitted onto the roll shaft after forming the cladding layer and performing the subsequent heat treatment. The roll exemplified in FIG. 1 is also manufactured by such a procedure.

If the roll for hot rolling process is manufactured by this method, the work can be simplified and made efficient in many steps for casting and heat treatments, and it is possible to reduce the manufacturing cost and to shorten the manufacturing duration. This is because the sleeve before being fitted onto the roll shaft is small in size relative to the whole roll including the roll shaft, and thus, it is light weight and easy to be handled.

Advantageous Effects of Invention

The roll for hot rolling process of the invention provides an excellent durability performance as a result of the cladding layer on the outer circumference portion having a high mechanical strength, corrosion resistance, wear resistance, seizing resistance, and the like, and thus, it is suitable for a wrapper roll, a pinch, roll, a mandrel, a conveyance roller, and the like to be used in the rolling equipment of the hot-rolled steel sheet. The cladding layer has a significant thickness, and thus, the roll can be used continuously over a significant long period of time by reworking the outer circumference surface in accordance with the progress of the wear. It is preferable in terms of ease of manufacturing and use and durability performance to adopt a configuration in which the sleeve made of carbon steel having the cladding layer described above on the outer circumference portion is fitted onto the outside of the roll shaft to form the body, or a configuration in which the cladding layer is formed by a continuous pouring process for cladding having the solid shaft or the sleeve forming the body as a core material.

In the method for manufacturing the roll for hot rolling process according to the invention, the cladding layer on the outer circumference portion is formed by a continuous pouring process for cladding. Therefore, the following are possible: a) a cladding layer having a uniform component and structure and a sufficient thickness can be efficiently formed; b) a boundary portion between the core material and the cladding layer can be bonded by a strong metal boding; and c) the mechanical strength, the corrosion resistance, and the like of the cladding layer can be enhanced by adding a large amount of alloy element. Therefore, according to the manufacturing method of the invention, it is possible to easily manufacture a roll for hot rolling process having an excellent durability performance. After the cladding layer is formed by the method described above, the durability performance of the cladding layer can further be improved by applying an appropriate heat treatment. If the body of the roll is configured by a sleeve and the sleeve on which the cladding layer is formed and the heat treatment has been performed is fitted onto the roll shaft to obtain the body, various types of tasks in a manufacturing process can be simplified and made efficient,

DESCRIPTION OF EMBODIMENTS

Figure 1:
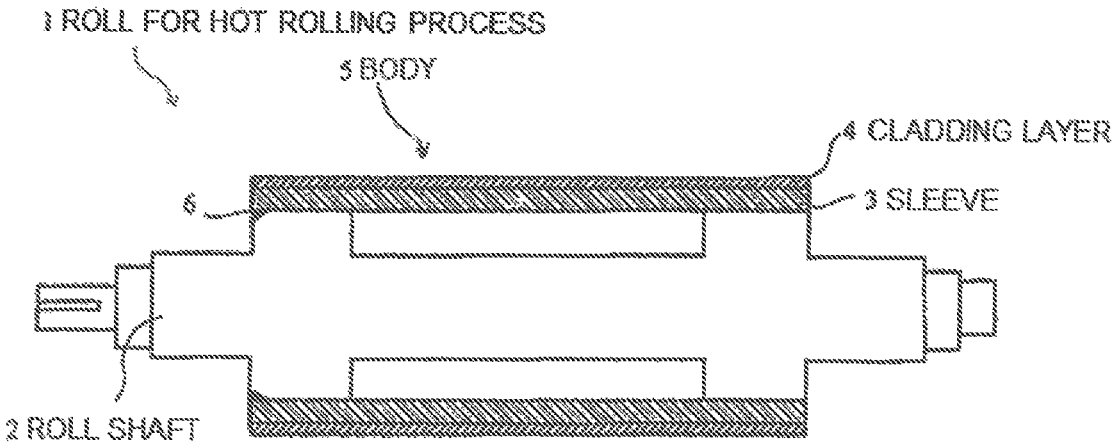
FIG. 1 is a longitudinal sectional view illustrating a roll for hot rolling process 1, where in particular, a roll to be used as a pinch roll of rolling equipment and the like is illustrated.

FIG. 1 illustrates a structure of a roll for hot rolling process 1, which is an example of the invention. In the roll 1 illustrated in the figure, a hollow sleeve 3 is attached on the outside of the roll shaft 2 by shrink fitting, and the cladding layer 4 is integrated as one with the outer circumference portion of the sleeve 3. The body 5 that is a portion contacting the hot-rolled steel sheet is formed by fitting the sleeve 3 having the cladding layer 4 onto the roll shaft 2. The roll shaft 2 and the sleeve 3 are fixed by a welding portion 6 at one end.

The body 5 of the roll 1 is used in a high temperature corrosive environment where cooling water and the like came in contact while the body 5 slides and collides with a hot-rolled steel sheet. Therefore, the cladding layer 4 (with a thickness of 5 mm or more, preferably, 10 mm or more) made of high-alloy steel is provided on the outside of the sleeve 3 made of low-carbon steel (for example, JIS-SS400) to enhance the mechanical strength, the corrosion resistance, and the like of the outer circumference portion.

Figure 2:
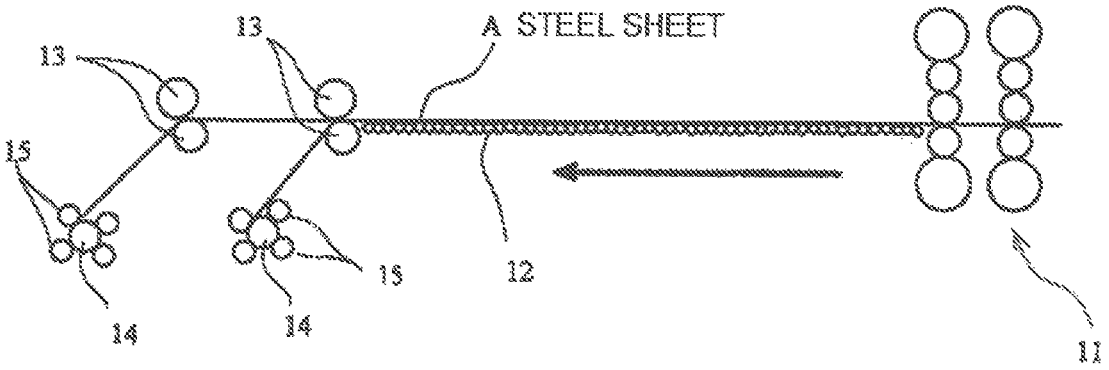
FIG. 2 is a schematic view illustrating an arrangement of various types of rolls for hot rolling process in rolling equipment of a hot-rolled steel sheet A.

FIG. 2 illustrates an arrangement diagram of various types of rolls for hot rolling process 12 to 15 including the roll having the same structure as that of the roll 1 of FIG. 1. In the rolling equipment of a hot-rolled steel sheet A, a plurality of rolls for hot rolling process including a run-out table roll (conveyance roll) 12, a pinch roll 13, a winding mandrel 14, a wrapper roll 14, and the like are arranged, for example, on a downstream side of a finishing rolling mill 11 as illustrated. Any of the rolls is used while being affected by a high mechanical load in a high temperature corrosive environment.

The roll 1 of FIG. 1 is configured to be used as the pinch roll 13 or the wrapper roll 14 in the arrangement of FIG. 2; however, the roll 1 can be used as another roll for hot rolling process. Further, for any of the rolls for hot rolling process, the structure of the roll is not limited to the structure of FIG. 1. For example, even if a roll, in which a roll shaft is integrated as one with the body not including the sleeve and a cladding layer is formed on the body, can be used as the roll for hot rolling process.

Figure 3:
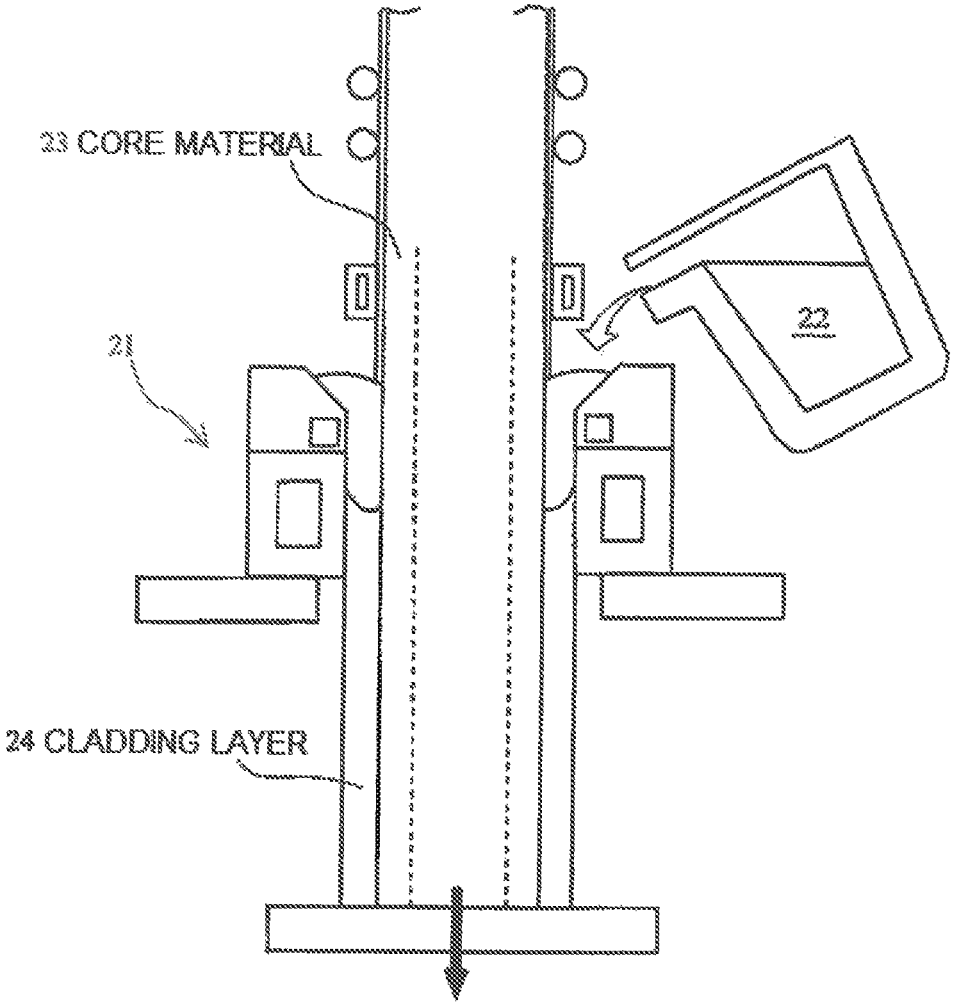
FIG. 3 is an explanatory diagram illustrating a continuous pouring process for cladding that is a part of a manufacturing process of the roll for hot rolling process.

In the roll 1 of FIG. 1, the cladding layer 4 on the outer circumference portion of the sleeve 3 is formed by a continuous pouring process for cladding, which is schematically illustrated in FIG. 3. That is, the above-described sleeve made of low-carbon steel (reference numeral 3 in FIG. 1) is concentric-vertically inserted in the inner portion of a hollow combined mold 21 as the core material 23 and the core material 23 is continuously lowered while the molten metal 22 is poured into an annular gap portion outside of the core material 23. Thus, the cladding layer 24 (that is, the cladding layer 4 of FIG. 1) is formed by depositing and solidifying the molten metal 22 described above onto the outer circumference of the core material 23 (that is, the sleeve 3 of FIG. 1).

Even if the roll has a different structure from that of FIG. 1, it is preferable that the rolls for hot rolling process 12 to 15 and the like illustrated in FIG. 2 is formed similarly by the continuous pouring process for cladding as shown in FIG. 3. If the roll does not have the sleeve, the body of the roll shaft is used as the solid core material 23, and the cladding layer 24 can be formed on the outer circumference of the core material 23.

After forming the cladding layer 24 on the outer circumference of the hollow or solid core material 23, the cladding layer 4 and the like are appropriately heat treated and the surface and the like are machine-finished. In the roll 1 in which the hollow sleeve 3 is used as in the example of FIG. 1, the sleeve 3 which have been subject to the heat treatment and the machine-finish is fitted onto the roll shaft 2.

The inventers prepared, for steel to be adopted in the cladding layer 4 of FIG. 1, a steel sample of a chemical component shown in the following Table 1 (where in any sample, the balance is Fe and inevitable impurities), and carried out various tests for the durability performance. In Table 1, the test sample of Comparative Example 1 is a material conventionally employed as the cladding layer for a wrapper roll and the like, and those of Examples 1 to 4 are materials for the cladding layer newly developed this time.

It is noted that, in each test, when an actual machine test described later was carried out, a roll in which the cladding layer was formed by using the continuous pouring process for cladding illustrated in FIG. 3 was manufactured and used. When tests other than the actual machine test were carried out, each test was performed by using a test piece obtained by a metal die mold for testing (inner diameter ϕ 90 mm×length 400 mm) similar in solidifying speed to a case where the roll was manufactured by the continuous pouring process for cladding. The manufactured test piece and the roll for the actual machine test were used after being subjected to a heat treatment in which the solution treatment was performed at 1000° C. for seven hours, which was followed by forced air cooling, and then, the age hardening treatment was carried out at 400 to 600° C. for seven hours. The annealing after the continuous pouring process for cladding was not performed.

TABLE 1

| Sample # | C | Si | Cu | Mn | Ni | Cr | Mo | Co | Nb | V |
|---|---|---|---|---|---|---|---|---|---|---|
| Example 1 | 0.64 | 2.94 | 0.96 | 1.58 | 2.78 | 13.8 | 0.8 | 1.08 | 0.36 | — |
| Example 2 | 0.86 | 4.12 | 1.02 | 1.6 | 3.05 | 13.9 | 1.98 | 0.93 | 1.01 | — |
| Example 3 | 0.86 | 4.08 | 1.04 | 1.55 | 3.06 | 13.8 | 2.82 | 0.92 | 1.01 | — |
| Example 4 | 0.86 | 4.01 | 1.01 | 1.49 | 2.97 | 13.5 | 3.54 | 0.9 | 0.96 | — |
| Comparative Example 1 | 0.51 | 2.99 | — | 0.7 | 5.79 | 7.26 | 1.53 | — | — | 0.23 |

In Example 1 in Table 1, a target value as follows is established for chemical component of the cladding layer 4. That is, the chemical component is: 0.5 to 0.7% by mass of C, 2.8 to 4.5% by mass of Si, 0.9 to 1.1% by mass of Cu, 1.4 to 1.6% by mass of Mn, 2.7 to 3.3% by mass of Ni, 13.5 to 14.5% by mass of Cr, 0.8 to 1.1% by mass of Mo, 0.9 to 1.1% by mass of Co, and 0.2 to 0.4% by mass of Nb (where the balance is Fe and inevitable impurities).

Cr has an effect of enhancing the corrosion resistance and Si has an effect of preventing the seizing, and thus, to appropriately obtain well balanced effects of both, ranges of both content amounts are set as above. When the amount of Si in the range described above is contained, Si provides an effect of improving the corrosion resistance under a condition of high temperature oxidation and high temperature water vapor. The appropriate amount of Mo and Co is included to improve the high temperature property. The appropriate amount of Nb is added for a purpose of suppressing the precipitation of the Cr carbide to the grain boundary and within the grain; preventing reduction of the corrosion resistance and the toughness resulting from reduction of the metal Cr; and suppressing solidification and growth of the crystal grain at the time of the solution treatment to finely granulate the crystal grain. Further, Cu is a precipitant hardening type element, and thus, the appropriate amount described above of Cu is added to improve the strength of the base structure.

In Examples 2 to A of Table 1, a target value as follows is established for chemical component of the cladding layer 4. That is, 0.7 to 0.9% by mass of C, 3.0 to 4.2% by mass of Si, 0.9 to 1.1% by mass of Cu, 1.4 to 1.6% by mass of Mn, 2.7 to 3.3% by mass of Ni, 13.5 to 14.5% by mass of Cr, 1.8 to 4% by mass of Mo, 0.9 to 1.1% by mass of Co, and 0.9 to 1.1% by mass of Nb (where the balance is Fe and inevitable impurities).

Compared to the chemical component of Example 1, amounts of C, Mo, and Nb are increased. The high temperature property of the cladding layer 4 is strengthened when the amount of these components are increased and contained in the above-described range.

Various tests were performed on the test piece manufactured by the method described above (each cladding layer of Example 1 and Comparative Example 1) and the property for the durability performance was investigated. Table 2 shows the results.

The test piece of Example 1 is higher in any of the tensile strength, the durability, the elasticity, the drawing, and the hardness than that of Comparative Example 1, and the same also applies to each property at a high-temperature. In the test piece of Example 1, a linear expansion coefficient is low and the durability is high, and thus, it is estimated that Example 1 has a superior performance in thermal crack resistance. Besides, Example 1 is higher in corrosion resistance, seizing resistance, and high-temperature oxidation property than Comparative Example 1.

Further, an actual machine test was performed for a roll having the cladding layer of Example 1 and a roll having the cladding layer of Comparative Example 1. That is, each of the rolls was used as a wrapper roll at an actual hot rolling factory for a predetermined duration (about 100 days). In the wrapper roll of the factory, the stainless steel sheet and the like are wound up at a temperature of over 700° C., and thus, a load applied on the outer circumference portion of the roll is high.

A result of the actual machine test described above indicated that the decreased amount of an outer diameter of the cladding layer of Example 1 by wear and the like (amount decreased per unit time) was 1/3.5 a similarly decreased amount of the cladding layer of Comparative Example 1. In addition, at the end of the above-described test duration, red rust was observed on the surface of the cladding layer of Comparative Example 1; however, red rust was not observed on the cladding layer 4, of Example 1 and a gloss observed before starting the test was maintained over a whole area of the surface.

Figure 4:
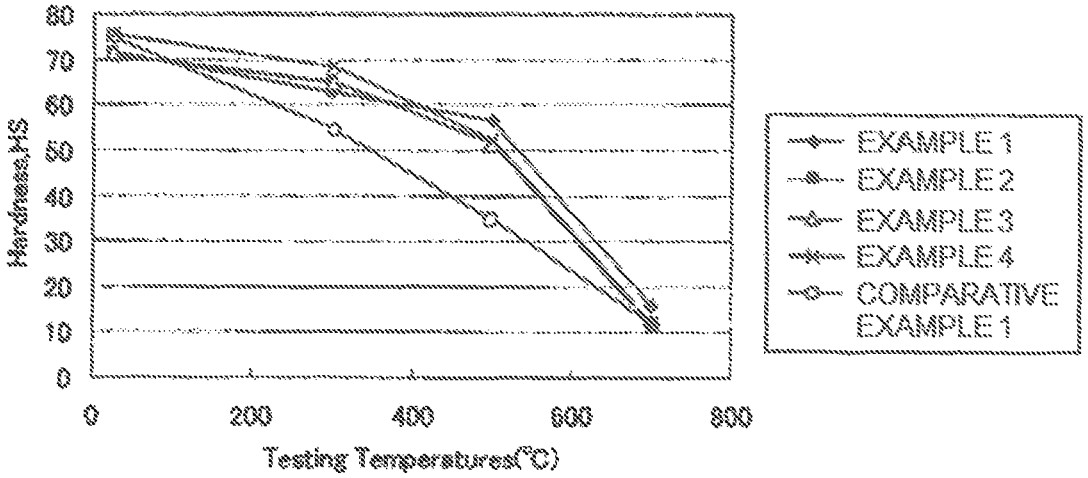
FIG. 4 is a graph showing a high temperature hardness of Examples 1 to 4 and Comparative Example 1, for a cladding layer provided on the roll for hot rolling process.

In addition, the inventors measured a high temperature hardness from a room temperature to 700° C. for all the test pieces including those of Examples 2 to 4. FIG. 4 shows the results.

TABLE 2

| | Material | Comparative Example 1 | Example 1 |
|---|---|---|---|
| General machine strength (accident resistance) | Tensile strength (Mpa) (500° C.) | 859 (899) | 950 (997) |
| | 0.2% Resistance (Mpa) (500° C.) | (819) | 890 |
| | Elasticity (%) (500° C.) | 0 (0.8) | 0.2 (0.22) |
| | Drawing (%) (500° C.) | 0 (0.2) | 1.8 (10) |
| | Total evaluation | Acceptable | Good |
| Wear resistance and corrosion resistance | Mechanical wear and hardness HS | Good: 65 to 75 | Very good: 65 to 75 |
| | (300° C., 500° C., 700° C.) | (54, 35, 12) | (63, 57, 16) |
| | Corrosion resistance (48 hrs (mg/mm$^2$) | Good (0.0200) | Very good (0.0049) |
| | Total evaluation | Good | Very good |
| Seizing resistance | Critical ratio to slip initiation (0.5 mm or more) | 40%, Good | 60%, Very good |
| Thermal shock resistance | Critical temperature for crack initiation | 800° C. or more | 800° C. or more |
| High temperature oxidation property | Increased amount of oxidation (900° C. × 24 hrs) | 52.22 g/m$^2$ · hr | 2.18 g/m$^2$ · hr |
| Heat resistance property | Ac1 Transformation point (° C.) | 570 | 670 |
| Coefficient of linear expansion (Thermal crack resistance) | 20 to 100° C. (×100° C.) | Acceptable: 13.9 | Very good: 11.1 |
| Surface roughening resistance | Prediction from the high temperature oxidation | Good | Very good |
| Total evaluation | | Good | Very good |

(A particular test among) various types of tests to find out the property shown in Table 2 (is) are carried out in a manner described below.

Corrosion resistance: Based on a salt spray testing method of JIS Z2371, a 48-hour test was performed to measure a corrosion mass loss before and after the test.

Seizing resistance: A slip ratio at a time of seizing (critical ratio to slip initiation, the seizing width of 0.5 mm or more) was investigated by rotating a test piece using a heat seizing and wear testing machine developed by FUJICO Co., Ltd. and pressing a load member onto a surface of the test piece at a predetermined pressure (it was assumed that the SUS would be hot rolled and a stainless steel material was used as a load member).

Thermal shock resistance: The test piece that has been checked in advance for no crack was heated up to a predetermined temperature and then thrown into water after which a heating temperature at which a crack occurred was measured.

High-temperature oxidation property: After being cleaned and dried, the test pieces were maintained at 900° C. for 24 hours in an electric furnace in the atmosphere and then cooled, and then, the increased amount of oxidation of the test piece where the mass of a scale was included was measured.

In all the test pieces of Examples 1 to 4, the hardness at 300° C. and 500° C. (and temperatures in the vicinity thereof) is far greater than the hardness of Comparative Example 1. This would result from an effect caused by a specially added element having a property of maintaining a high-temperature strength in Examples 1 to 4. It is estimated that a high degree of hardness in a high-temperature region provides an advantageous effect on the wear property of the roll in the actual machine usage environment as well as a scratch resistance, a seizing resistance, and the like.

REFERENCE SIGNS LIST

1 Roll for hot rolling process
2 Roll shaft
3 Sleeve
4 Cladding layer
5 Body
13 Pinch roll
15 Wrapper roll

The invention claimed is:

1. A roll for hot rolling process used in rolling equipment for hot-rolled steel, comprising:

at least one of a solid shaft and a sleeve forming a body of the roll; and a cladding layer on an outer circumference portion of the solid shaft or sleeve, wherein the cladding layer comprises: 0.5 to 0.7% by mass of C, 2.8 to 4.0% by mass of Si, 0.9 to 1.1% by mass of Cu, 1.4 to 1.6% by mass of Mn, 2.7 to 3.3% by mass of Ni, 13.5 to 14.5% by mass of Cr, 0.8 to 1.1% by mass of Mo, 0.9 to 1.1% by mass of Co, and 0.2 to 0.4% by mass of Nb, with a balance being Fe and inevitable impurities, and has a thickness of 5 mm or more, wherein in the cladding layer, a high temperature hardness at 500° C. is HS 50 or more, wherein the outer circumference portion of the solid shaft or sleeve forming a body of the roll has the cladding layer formed by a continuous pouring process for cladding, wherein the solid shaft or the sleeve formed with the cladding layer is quenched by a forced air cooling after being subject to a solution treatment at 1000° C. for seven hours, and is further subject to an aging treatment at 400 to 600° C. for seven hours while annealing heat treatment is not performed after the continuous pouring process, and wherein corrosion mass loss of the cladding layer is 0.0065 mg/mm$^2$ or less in a 48-hour corrosion resistance test defined in Japanese Industrial Standard Z2371 (JIS Z2371).

2. A roll for hot rolling process used in rolling equipment for hot-rolled steel, comprising:

at least one of a solid shaft and a sleeve forming a body of the roll; and a cladding layer on an outer circumference portion of the solid shaft or sleeve, wherein the cladding layer comprises: 0.7 to 0.9% by mass of C, 3.0 to 4.5% by mass of Si, 0.9 to 2.0% by mass of Cu, 1.4 to 1.6% by mass of Mn, 2.7 to 3.3% by mass of Ni, 13.5 to 14.5% by mass of Cr, 1.8 to 4% by mass of Mo, 0.9 to 3.0% by mass of Co, and 0.4 to 1.5% by mass of Nb, with a balance being Fe and inevitable impurities, and has a thickness of 5 mm or more, wherein in the cladding layer, a high temperature hardness at 500° C. is HS 50 or more, wherein the outer circumference portion of the solid shaft or sleeve forming a body of the roll has the cladding layer formed by a continuous pouring process for cladding, wherein the solid shaft or the sleeve formed with the cladding layer is quenched by a forced air cooling after being subject to a solution treatment at 1000° C. for seven hours, and is further subject to an aging treatment at 400 to 600° C. for seven hours while annealing heat treatment is not performed after the continuous pouring process, and wherein corrosion mass loss of the cladding layer is 0.0065 mg/mm$^2$ or less in a 48-hour corrosion resistance test defined in Japanese Industrial Standard Z2371 (JIS Z2371).

3. The roll for hot rolling process according to claim 1, wherein a sleeve made of carbon steel has the cladding layer on the outer circumference portion, and the sleeve is fitted onto an outside of a roll shaft to form a body.

4. A method for manufacturing a roll for hot rolling process used in rolling equipment for hot-rolled steel, the roll including a cladding layer on an outer circumference portion, wherein the cladding layer comprises: 0.5 to 0.7% by mass of C, 2.8 to 4.0% by mass of Si, 0.9 to 1.1% by mass of Cu, 1.4 to 1.6% by mass of Mn, 2.7 to 3.3% by mass of Ni, 13.5 to 14.5% by mass of Cr, 0.8 to 1.1% by mass of Mo, 0.9 to 1.1% by mass of Co, and 0.2 to 0.4% by mass of Nb, with a balance being Fe and inevitable impurities, and has a thickness of 5 mm or more, and wherein in the cladding layer, a high temperature hardness at 500° C. is HS 50 or more, comprising the steps of:

using a solid shaft or a sleeve forming a body as a core material and forming the cladding layer on an outer circumference portion thereof by a continuous pouring process for cladding; and quenching the solid shaft or the sleeve formed with the cladding layer by a forced air cooling after subjecting the solid shaft or the sleeve formed with the cladding layer to a solution treatment at 1000° C. for seven hours, and further subjecting the solid shaft or the sleeve formed with the cladding layer to an aging treatment at 400 to 600° C. for seven hours while annealing heat treatment is not performed after the continuous pouring process, wherein corrosion mass loss of the cladding layer is 0.0065 mg/mm$^2$ or less in a 48-hour corrosion resistance test defined in Japanese Industrial Standard Z2371 (JIS Z2371).

5. The method for manufacturing the roll for hot rolling process according to claim 4, wherein after the sleeve formed with the cladding layer is subject to the solution treatment, the quenching, and the aging treatment, the sleeve is fitted onto an outside of a roll shaft to form a body.

6. A method for manufacturing a roll for hot rolling process used in rolling equipment for hot-rolled steel, the roll including a cladding layer on an outer circumference portion, wherein the cladding layer comprises: 0.7 to 0.9% by mass of C, 3.0 to 4.5% by mass of Si, 0.9 to 2.0% by mass of Cu, 1.4 to 1.6% by mass of Mn, 2.7 to 3.3% by mass of Ni, 13.5 to 14.5% by mass of Cr, 1.8 to 4% by mass of Mo, 0.9 to 3.0% by mass of Co, and 0.4 to 1.5% by mass of Nb, with a balance being Fe and inevitable impurities, and has a thickness of 5 mm or more, and wherein in the cladding layer, a high temperature hardness at 500° C. is HS 50 or more, comprising the steps of:

using a solid shaft or a sleeve forming a body as a core material and forming the cladding layer on an outer circumference portion thereof by a continuous pouring process for cladding; and quenching the solid shaft or the sleeve formed with the cladding layer by a forced air cooling after subjecting the solid shaft or the sleeve formed with the cladding layer to a solution treatment at 1000° C. for seven hours, and further subjecting the solid shaft or the sleeve formed with the cladding layer to an aging treatment at 400 to 600° C. for seven hours while annealing heat treatment is not performed after the continuous pouring process, wherein corrosion mass loss of the cladding layer is 0.0065 mg/mm$^2$ or less in a 48-hour corrosion resistance test defined in Japanese Industrial Standard Z2371 (JIS Z2371).

7. The method for manufacturing the roll for hot rolling process according to claim 6, wherein after the sleeve formed with the cladding layer is subject to the solution treatment, the quenching, and the aging treatment, the sleeve is fitted onto an outside of a roll shaft to form a body.

* * * * *